United States Patent [19]

Watts et al.

[11] Patent Number: 4,459,573

[45] Date of Patent: Jul. 10, 1984

[54] HIGH POWER PULSE OPERATED RELAY

[75] Inventors: Roger E. Watts; Leon R. Britton, both of Chicago; Harry K. Mactague, Lombard, all of Ill.

[73] Assignee: Guardian Electric Manufacturing Company, Chicago, Ill.

[21] Appl. No.: 376,185

[22] Filed: May 7, 1982

Related U.S. Application Data

[63] Continuation-in-part of Ser. No. 234,739, Feb. 17, 1981, Pat. No. 4,386,330.

[51] Int. Cl.[3] ..... H01H 9/20

[52] U.S. Cl. ..... 335/167; 337/171

[58] Field of Search ..... 335/131, 167, 168, 169, 335/170, 171, 185, 190

[56] References Cited

U.S. PATENT DOCUMENTS 3,005,890 10/1961 White et al. ..... 335/131

3,715,694 2/1973 Kruger ..... 335/131 X

*Primary Examiner*—George Harris

*Attorney, Agent, or Firm*—Allegretti, Newitt, Witcoff & McAndrews

[57] ABSTRACT

An improved solenoid actuated switch assembly is retained within a housing made from insulating material having three generally parallel recessed passages. The solenoid actuator is retained within the center passage or recess and the parallel side recesses retain heavy duty contacts and blades. A passage between the recesses permits a compressible spring actuating arm laterally projecting from the solenoid recess to drive the contact blades in response to movement of the solenoid corepiece. A pivot arm and cam assembly cooperate to retain the corepiece in a first or second position following momentary actuation of the corepiece in response to a signal through the coil.

17 Claims, 14 Drawing Figures

HIGH POWER PULSE OPERATED RELAY

This application is a continuation-in-part of pending application Ser. No. 234,739, filed Feb. 17, 1981, now U.S. Pat. No. 4,386,330, entitled "High Power Pulse Operated Relay" which is incorporated herewith by reference.

CROSS REFERENCE TO RELATED APPLICATIONS AND PATENTS

This invention is generally related to the subject matter of patent application Ser. No. 101,469 filed Dec. 10, 1979 in the name of William W. Wright for a "Bistable Control Switch". That application has now matured into U.S. Pat. No. 4,270,108. That application is incorporated herewith by reference.

BACKGROUND OF THE INVENTION

This invention relates to an improved switch and more particularly to a solenoid actuated switch wherein switch contacts are switched to and retained in an open or closed contact position subsequent to momentary or pulse actuation of the solenoid.

Referring to the referenced patent, there is taught a bistable control switching mechanism especially useful in combination with a coil actuated pivotal armature. The switch mechanism therein disclosed is also especially useful for low power requirements such as encountered in a household current environment.

A device of the type disclosed would also be useful in higher current and higher power environments. In such environments it is necessary, for example, to open a circuit in response to the momentary impulse of a control signal. Such a switching mechanism would be useful as an overload protector and for various other purposes such as those described in the referenced patent application.

While the structure disclosed in the referenced patent application would be useful and could be used for high power applications, the development of an improved bistable, pulse operated switch particularly for high power applications was sought. The parent application to this application, Ser. No. 234,739, discloses such an improved relay.

There a solenoid is positioned in the center one of three parallel recesses in an insulating block. Contacts are positioned in the recesses on the opposite sides of the center recess. A spring arm driven by the solenoid projects into each side recess and drives the contacts open or closed. The switch is bistable since the solenoid drives an actuator which is maintained in either one of two positions by action of a cam and follower associated with the solenoid actuator.

The present invention relates to an improved solenoid actuator assembly for such a relay as well as other improvements.

SUMMARY OF THE INVENTION

Briefly the present invention comprises a solenoid actuated relay or switch wherein the solenoid has an axially translatable corepiece positioned within a recess in a housing. A compressible actuator spring arm projects generally laterally from an extension of the corepiece and extends through a passage into an adjacent recess in the housing where it is connected to a movable contact blade and drives the contact blade to make or break a circuit. The corepiece extension also includes a cam follower assembly cooperative with a special cam to retain the corepiece and thus the connected, movable contacts in one of two stable control positions. The corepiece is actuated in response to a momentary impulse of current through the solenoid coil. This will cause the corepiece to be released from one position and move to a second position to be retained in that position until the next momentary signal is pulsed through the coil. Serial momentary pulses of the solenoid transfer the corepiece, its extension and connected components between bistable positions that make or break the contacts of the switch.

Thus, it is an object of the present invention to provide an improved two position, bistable solenoid actuated switch or relay.

It is a further object of the present invention to provide a two position switch which includes a solenoid member operative in response to a low power input to effect switching of contacts capable of carrying very high loads. The switch is maintained in a fixed position following each momentary control signal to the solenoid coil.

Still another object of the present invention is to provide an inexpensive and reliable bistable switch which may be used for interrupting or reconnecting an electrical circuit, especially a high power circuit.

One further object of the present invention is to provide an improved bistable control switch having enhanced safety characteristics.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
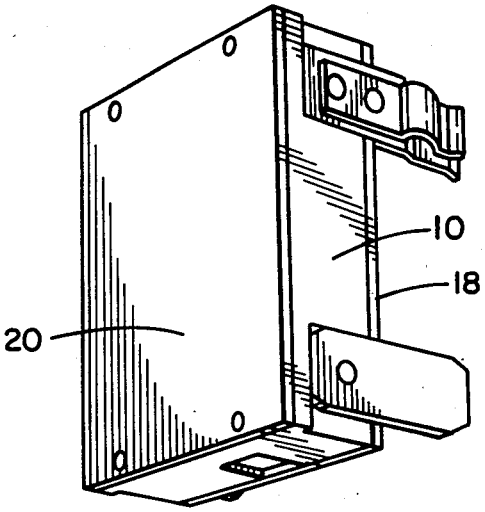
FIG. 1 is a perspective view of the switch of the invention wherein the cover for the switch is placed over the switch to encapsulate the switch.
Figure 2:
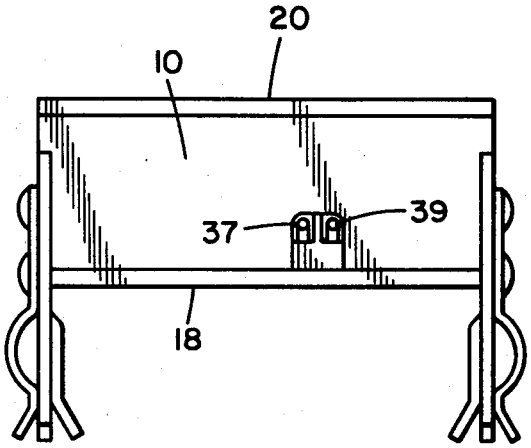
FIG. 2 is an end view of the switch of FIG. 1.
Figure 3:
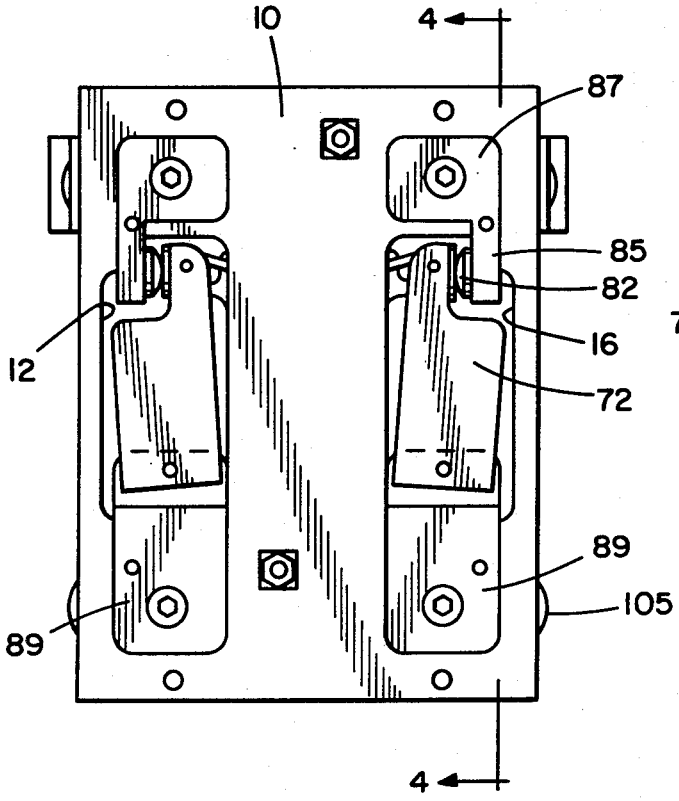
FIG. 3 is a bottom plan view of the switch illustrating the side recesses which retain the contacts with the contacts in the closed position.

FIGS. 1 and 2 of the drawing illustrate the general configuration of the relay of the present invention. FIGS. 3–5 and 12–14 illustrate the contact construction. FIGS. 6–11 illustrate the solenoid switch actuator for the relay.

Referring to the figures, the switch assembly of the present invention is retained within a housing 10 that has three generally parallel recesses 12, 14 and 16 arranged longitudinally within the housing 10. Covers 18 and 20 cooperate with the planar sides of the housing 10 to retain the switch components within the housing 10. The center recess 14 receives the solenoid assembly itself. The side recesses 12 and 16 receive switch blade assemblies and are interconnected with the solenoid assembly 14 by means to be described below. The center recess 14 is defined as a counterbore recess in one side of the housing 10 whereas the side recesses 12 and 16 are defined as counterbores from the opposide sides of the block or housing 10. Passages 22 and 24 interconnect the center recess 14 with the side recesses 16 and 12, respectively.

The Solenoid Assembly

As shown in the figures, the solenoid assembly is retained in the middle recess 14. The assembly includes a solenoid frame 26 which is retained on a mounting plate 28. The plate 28 is attached to the bottom of recess 14 by means of fasteners 30. The fasteners 30 fit through slots 32 in the plate 28 so that the solenoid plate 28, frame 26 and attached components may be adjusted longitudinally within the recess 14.

The solenoid frame 26 encapsulates a solenoid coil 34. Leads 36 and 38 are provided for the coil 34. The leads 36 and 38 are connected to external contacts 37 and 39 in the wall of the housing 10 (FIG. 2).

Figure 9:
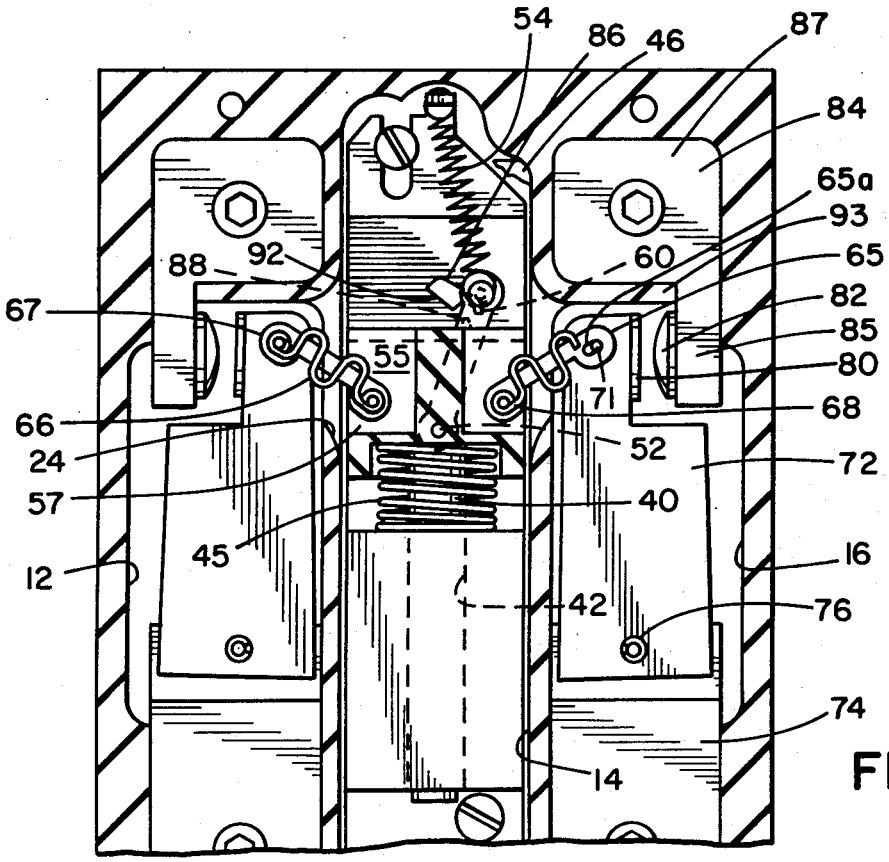
FIG. 9 is a top cross sectional view of the switch similar to FIG. 8 wherein the switch is actuated by a current impulse through the solenoid.

The solenoid assembly includes a core or plunger 40 which is translatable within a center passage 42 defined by the coil 34. The plunger 40 thus moves in response to passage of a current through coil 34. The end of plunger 40 projects from the passage 42 and is rigidly connected to a sliding block 48. A spring 45 is interposed between the frame 26 and block 48 to bias the plunger longitudinally from the frame 26. The block 48 is sized to slide easily along the sides of the recess 14 and thus center and guide the plunger 40. The travel of block 48 as biased by spring 45 is limited by the head 47 of an adjustable bolt 49 in a block 46 fixed in recess 14 as shown in FIG. 9.

Figure 6:
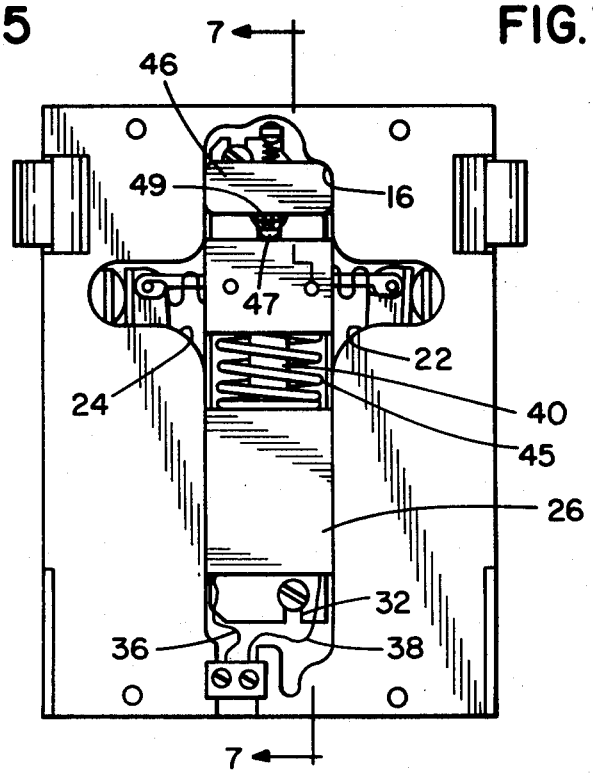
FIG. 6 is a top plan view of the switch illustrating the center recess and wherein the solenoid has been actuated to position the contacts in a closed condition.
Figure 8:
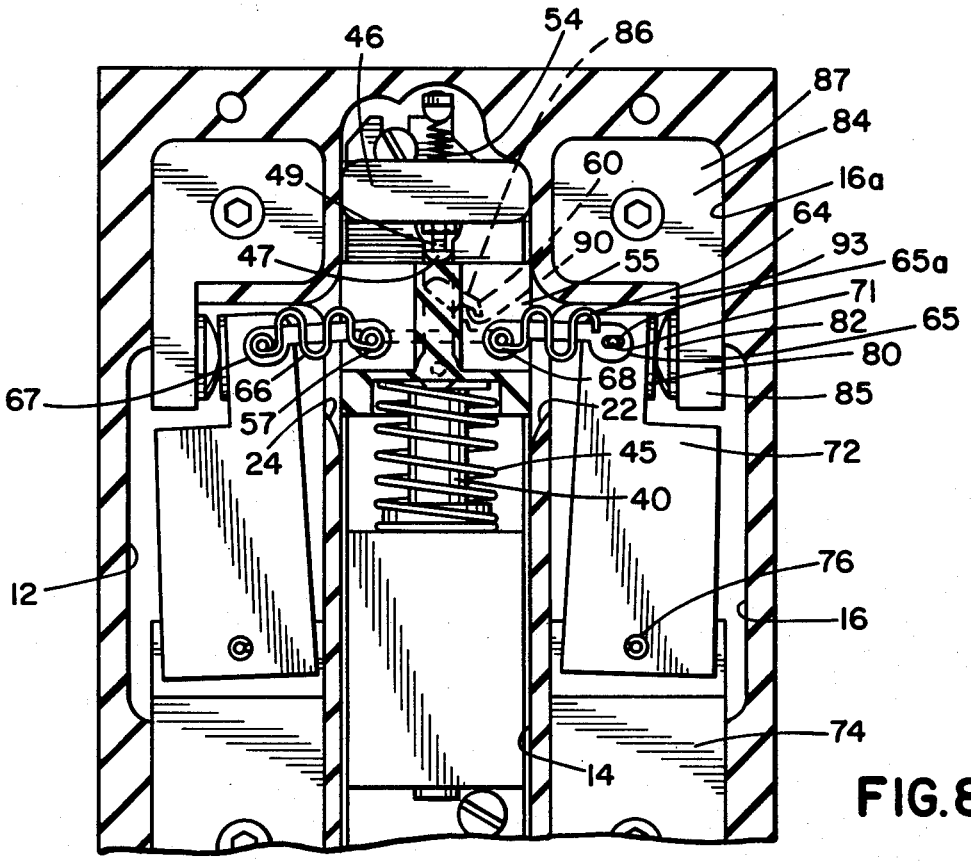
FIG. 8 is a cross sectional view of the switch illustrating the position of the center and side recesses with the contacts in the closed position.

The block 48 has a cantilever cam follower arm 50 pivotally attached in a slot 51 to block 48 by a pivot pin 52. The pivot pin 52 lies generally on the midline axis of translation of the plunger 40. The arm 50 pivots about the pin 52 in the plane of the housing 10 as shown in FIGS. 6, 8 and 9. The arm 50 is a rigid arm which terminates at its extreme end with a downwardly extending cam follower pin 54.

Attached to the outer end of the arm 50 is a spring 56 which connects at its opposite end to a post 58 affixed to the mounting plate 28. The spring 56 acts on the arm 50 to rotate or pull the arm 50 about the pivot pin 52 so that the arm 50 will align itself on the axis of plunger 40.

The pin 54 cooperates with a cam 60 that is formed in a cam plate or cam mounting plate 62. The plate 62 is affixed to the solenoid mounting plate 28 and is adjustable with respect thereto in a direction along the axis of plunger 40. The cam 60 has a shape of the type disclosed in U.S. Pat. No. 4,270,108, Ser. No. 101,469 referenced herein before. The pin 54 cooperates with the cam 60 in the manner described in said patent.

Attached on opposite sides of the pivot pin 52 and extending from separate slots 55, 57 laterally from the sliding block 48 are actuating, compressible spring arms 64 and 66 and solid links 65 and 67 respectively. The spring arm 64 is pivotally attached to block 48 at pivot point 68. The arm 64 is a generally sinusoidally shaped compressible spring which connects at its opposite end to a pivot pin 71 on movable contact blade 72.

Solid link 65 also pivotally connects block 48 from point 68 to blade 72 at pin 71. However, link 65 has a lost motion slot 65*a* at its connection with pin 71. The slot 65*a* is dimensioned so that pin 71 will be between the ends of the slot 65*a* when link 65 is in the position of FIG. 10 at rest. The slot 65*a* is also dimensioned so that the pin 71 will be between the ends of the slot 65*a* when the link 65 is in the position of FIG. 6 and FIG. 8, i.e., the contacts are closed and the spring arm 64 is compressed slightly. The outer end of slot 65*a* serves to limit the tension extension of spring arm 64 when the relay is moved from the position of FIG. 8 toward the position of FIG. 10. That is, the sudden actuation of the solenoid to open the contacts causes the spring arm 64 to stretch and ultimately fail upon repeated cycling. The link 65 prevents undesired stretching and failure.

Thus, movement of the block 48 in response to actuation of the plunger 40 causes the arm 64 and link 65 to translate the blade 72 in the plane of the housing 10. The arm 66 and link 67 are of similar construction to that described for the arm 64 and link 65. Importantly, each arm 64, 66 is elastically compressible and has an uncompressed length greater than the distance between the pin 68 and pin 71 when the contact blade 72 is in the contact closed position. Also, when the spring arms 64, 66 are in compression and the contacts are closed, the links 65, 67 do not interfere or affect the compression action of spring arms 64, 66.

The Blade and Contact Assembly

A blade and contact assembly is retained in recess 16. As shown in FIGS. 8–11, movable blade 72 is attached to a connector bar 74 at a pivot point 76. The blade 72 thus pivots about the point 76. Both the blade 72 and the bar 74 are preferably made from a conductive copper material. The blade 72 and bar 74 are electrically connected by means of a flexible wire conductor 78. A contact 80 is attached to the blade 72. A contact 82 is affixed to a stationary contact bar or buss bar 84. Pivotal movement of the blade 72 away and toward block 48 causes the contacts 80 and 82 to respectively make and break a circuit. The bars 74 and 84 thus connect with high power lead wires. The blade and contact assembly associated with the recess 14 is of similar construction though a mirror image of that just described with respect to the recess 12.

Note that as shown in FIGS. 8–11, the actuating wire or arm 64 extends through the passage 22 from the recess 14 into the recess 16 and more particularly from the sliding block 48 to the movable blade 72. In this manner the blade and contact assemblies of the relay are insulated from one another and from the solenoid assembly to prevent any arcing or short circuiting.

Figure 4:
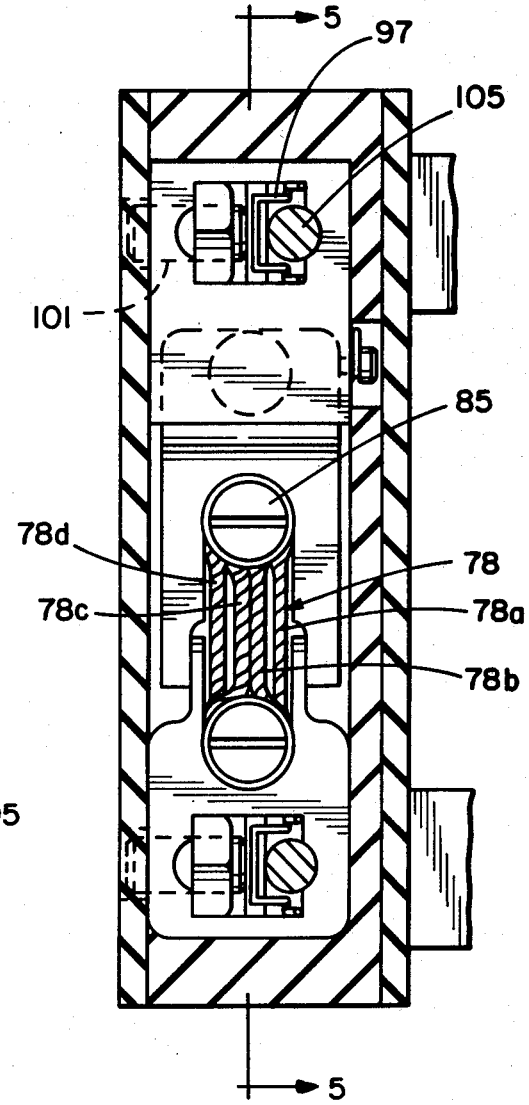
FIG. 4 is a side cross sectional view of the switch taken along the line 4—4 in FIG. 3.
Figure 5:
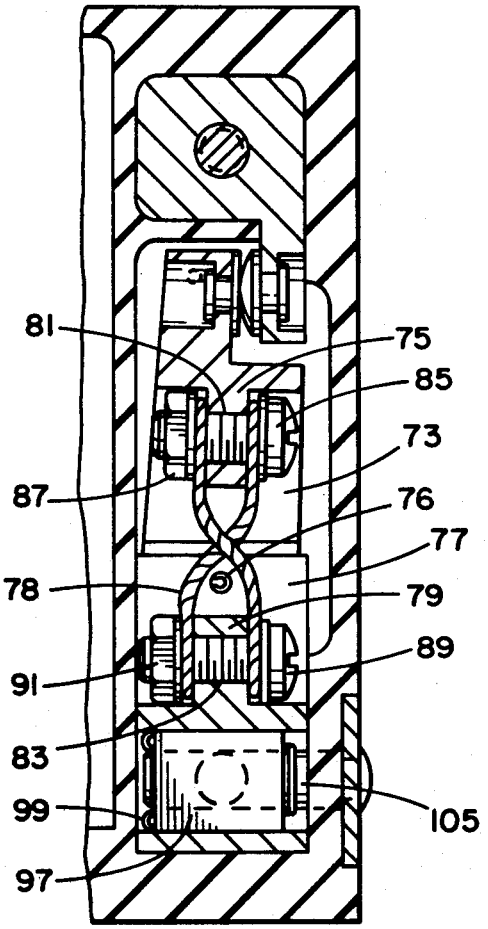
FIG. 5 is a partial top cross sectional view of the contacts for the switch taken along the line 5—5 in FIG. 4.
Figure 7:
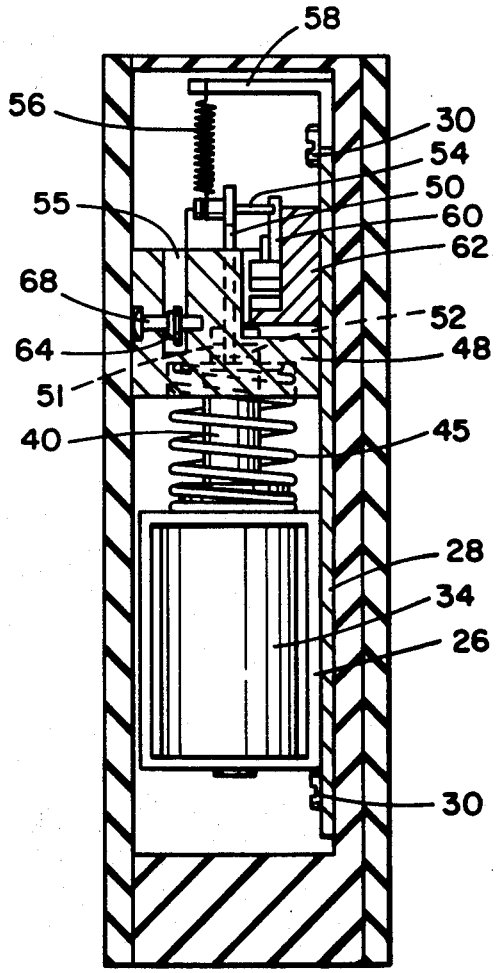
FIG. 7 is a side cross sectional view of the center recess taken along the line 7—7 in FIG. 6.

FIGS. 4 and 5 illustrate a further feature of the blade and contact assembly; namely, the construction of the wire conductor 78 which connects movable blade 72 and connector bar 74. The wire conductor is comprised of a plurality of braided copperwires 78*a*, 78*b*, 78*c* and 78*d*. The blade 72 includes a middle slot 73 with a rib 75. Similarly the blade or bar 74 includes a slot 77 with a rib 79. The ribs 75, 79 each include a passage 81, 83 respectively. Passages 81, 83 are generally parallel and lie in a plane defined by the sweep or movement of blade 72. A bolt 85 fits through passage 81 and retains looped end of braided copperwires 78*a*, 78*c* against one side of rib 75 and wires 78*b*, 78*d* against the opposite side of rib 75. The bolt 85 and wires 78 are retained by a nut 87. Similarly a bolt 89 is retained by a nut 91 and cooperates with the opposite end of wires 78*a*, 78*b*, 78*c*, 78*d*, as well as passage 83.

Importantly the wires 78*a*, 78*b*, 78*c*, 78*d* cross or weave between connections by bolts 85, 89. This crossing arrangement of wires 78*a*, 78*b*, 78*c*, 78*d* in the plane of the passages 81, 83 eliminates or reduces forces on the pivoting blade 72 and permit the blade 72 to pivot easily about pin 76 and also reduces stress and bending forces on the conducting wires 78*a*, 78*b*, 78*c*, 78*d*. Thus, the movable blade 72 can be easily pivoted between the "make" and "break" condition.

Figure 14:
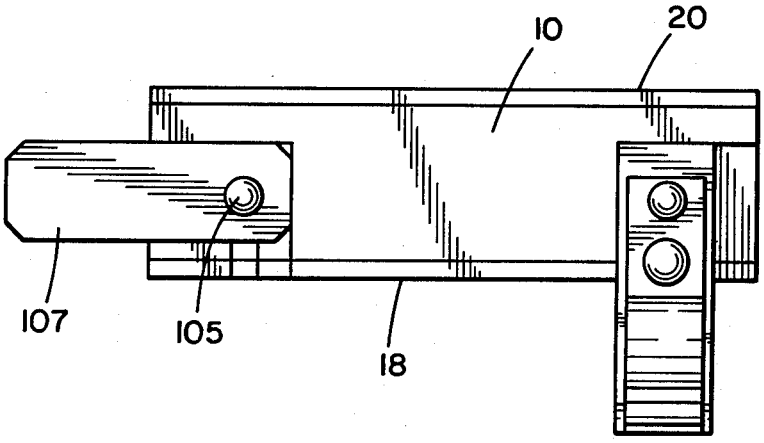
FIG. 14 is another side view of the switch and contacts.

FIGS. 4 and 12–14 illustrate the buss bar connection for the relay of the invention. The buss bar 84 comprises an L-shaped member having a leg 85 upon which is mounted the contact 82. The bar 84 also includes a hollow body 87 having a lower leg 89 and an upper leg 91. The legs 89, 91 are spaced from each other and sized to fit in a subreceptacle 16*a* defined by the curved wall 93. The legs 89, 91 define an enclosure for spring contact plate 97 biased toward leg 89 by V spring 99. A contact drive bolt 101 threaded in leg 89 engages the plate 97. A passage 103 in the side wall of body 10 is adapted to receive a conducting rod 105 of a terminal contact assembly 107. When the rod 105 is inserted in the passage 103 between plate 97 and leg 91, the bolt 101 is tightened down to retain the rod 105. The rod 105 may be rotated to a desired position in order to position the assembly 107 in a desired orientation as illustrated in FIG. 14. Bar 74 is of a similar construction to bar 84.

Cam Form and Solenoid Operation

Referring first to FIG. 8, the assembly is in a position where there is no current passing through the solenoid coil 34. Thus, compression spring 45 which is positioned between the frame 26 and block 48 projects the block 48 to its full extended position which is limited by a retaining nut on the opposite end of the solenoid core. In this position the arms 64 and 66 are extended to their maximum transverse orientation thereby closing the contacts 80 and 82. Spring 56 draws the arm 50 along the axis of plunger 40 and retains it in a straight line configuration.

FIG. 9 represents the next step in the operation of the solenoid assembly. That is, the solenoid coil 34 is actuated by passage of current therethrough. This causes the plunger 40 to be drawn against the force of the compression spring 45. Simultaneously the block 48 is withdrawn in the same direction causing the arms 64 and 66 to pivot their associated blades 72 and break the circuit through the contacts 80 and 82 by separating those contacts. At the same time the pin 54 of arm 50 engages against the inclined cam surface 86 causing the arm 50 to pivot in a clockwise direction and follow the surface 86.

Figure 10:
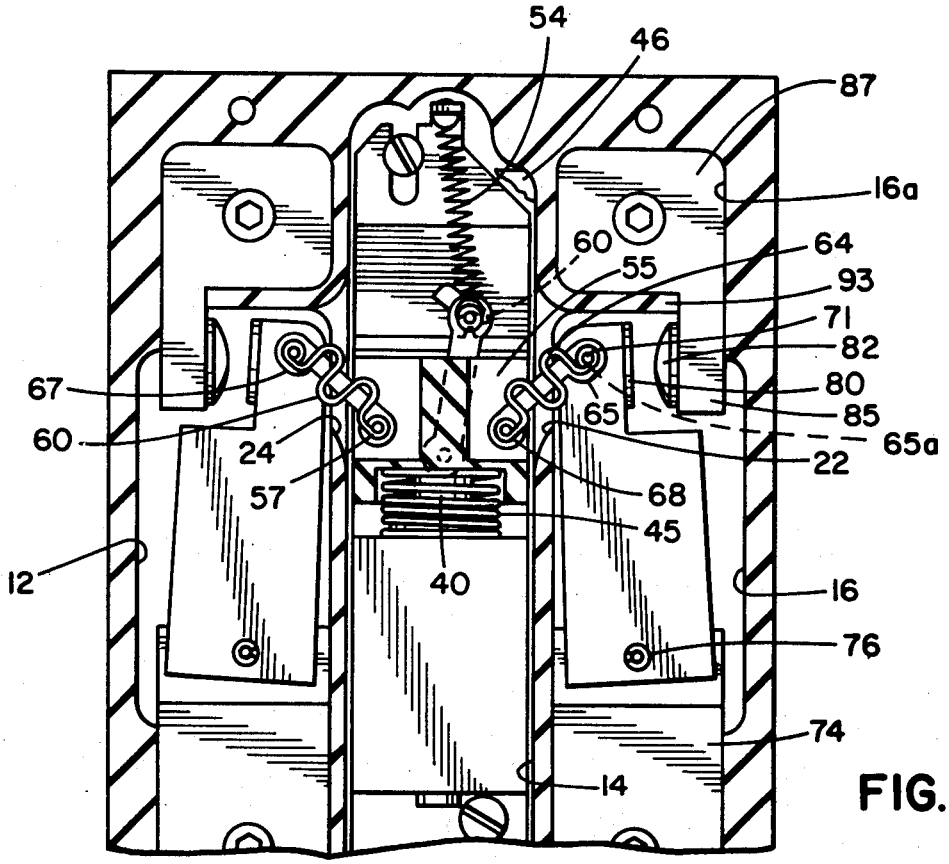
FIG. 10 is a top cross sectional view of the switch similar to FIG. 9 wherein the solenoid current has been terminated and the contacts are maintained in the open condition.

Subsequently, as shown in FIG. 10, the solenoid plunger 40 is withdrawn to its maximum actuated downward position. This causes the pin 54 to follow the surface 86 to its maximum extent where it is released from that surface. Release is effected by action of the spring 56 causing the arm 50 to pivot in a clockwise direction. The pin 54 then engages against the upward wall or stop 88 where the pin 54 is retained so long as the coil 34 receives current.

Subsequently, the solenoid coil 34 is deactivated. This permits the plunger 40 to rise slightly due to the action of the compression spring 45. The pin 54 then rides into slot 90 in the cam 60. Further translation of the plunger 40 is prevented by the coaction of pin 54 and slot 90. Note that the contacts 80 and 82 remain in an open position even though current through the coil 34 has been terminated. Also, the slot or notch 90 is on the clockwise side of the center line axis of the plunger 40.

Figure 11:
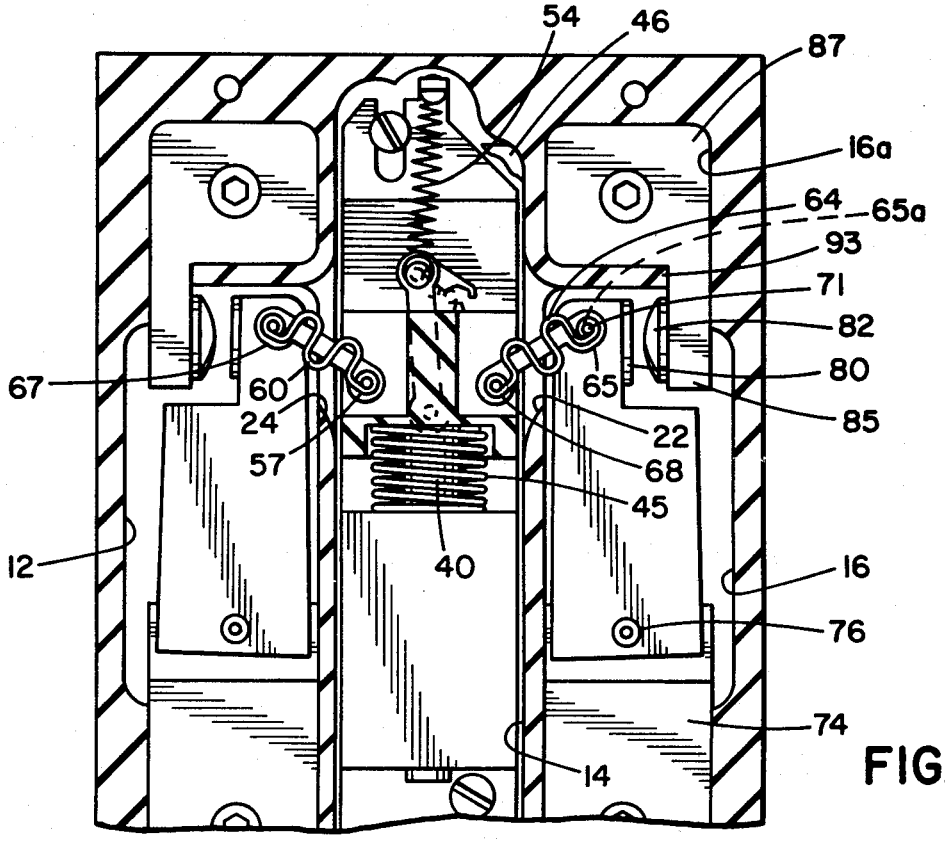
FIG. 11 is a top cross sectional view of the switch similar to FIG. 10 wherein the solenoid current has again been actuated to release the contacts from their open position.
Figure 12:
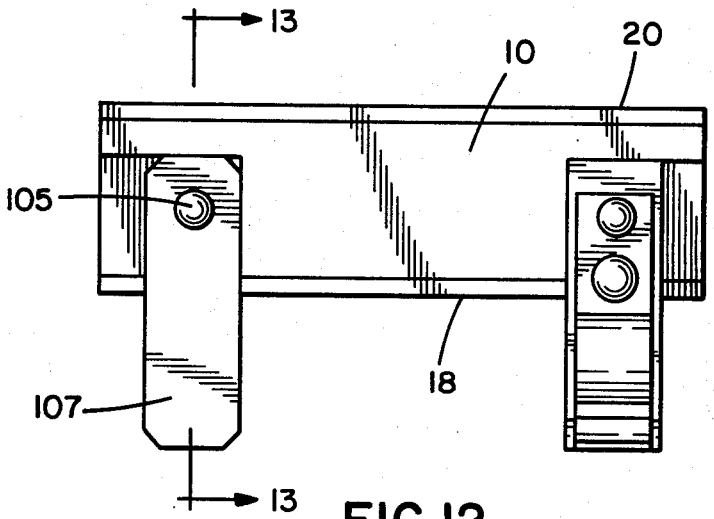
FIG. 12 is a side view of the switch of FIG. 1.
Figure 13:
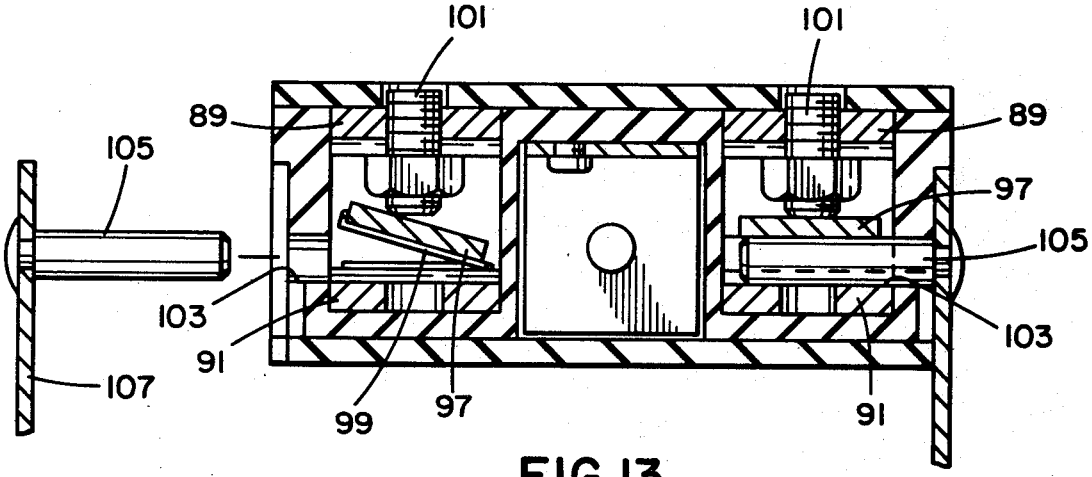
FIG. 13 is a cross sectional view of the contacts of the switch.

FIG. 11 represents the next sequential step in the operation of the device. In FIG. 11 the coil 34 is again actuated causing the pin 54 to follow along the left hand side of the notch 90 and where it is released from that notch 90 as the pin is retracted in the downward direction due to actuation of the coil. Release from the notch 90 is effected by means of the force associated with the spring 56. The component of force is transverse to the direction of the axis of the plunger 40. The current through the coil 34 thus aligns the arm 50 in a direction straight along the axis of plunger 40.

Release of current through the coil 34 will then permit the spring 45 to drive the block 48 and cause translation and movement of the various component parts as shown in FIG. 6. Thus, the plunger 40 is driven by the compression spring 45 so that the pin 54 rides against the back side surface 92 of the cam 60 and over the end 94 of the cam 60. Again, the spring 56 causes the pin 54 to remain against the cam surface and to be drawn toward the center line axis of plunger 40. The final position of the assembly is represented again by FIG. 8. The cycle can then be repeated by two complete momentary actuation signals through the solenoid coil 34.

The Compressible Spring Actuating Arms

Movement of the block 48 between the positions of FIGS. 8 and 9 alternately compresses and releases the compressible spring arms 64, 66 from compression. The forces on the contacts 80, 82 in the closed position thus are dependent upon the spring constant ($k_1$) and the amount of compression ($\Delta x$) of the spring arm 64. This can be expressed by the formula: F (compression)$=k_1\Delta x$. When the spring arm 64 makes an angle of $\theta$ with respect to the solenoid axis, the force becomes a vector force determined by the formula: $F=k_1\Delta x \sin\theta$. The remaining vector force ($k_1\Delta x \cos\theta$) is cumulative with the force of the spring 45 and is defined by the formula: $F=k_1\Delta x \cos\theta$. Thus, the spring arm 64, 66 provides a force component which facilitates the movement of block 48 in response to the force of spring 45. The size of spring 45 may be decreased slightly because of the cumulative effect of the forces from the arms 64, 66. The arms 64, 66, since they are springs, positively hold the contacts 80, 82 in a closed position to reduce arcing and also positively break the contacts.

Thus, it can be seen that the present invention relates to an improved bistable switch assembly which utilizes a solenoid in combination with a special cam and follower assembly so that the momentary actuation of the solenoid will permit maintenance of the switch in an open or closed circuit position. The switch is especially useful for high powered or high current applications. While in the foregoing there has been set forth a preferred embodiment of the invention, it is to be understood that the invention is limited only by the following claims and their equivalents.

What is claimed is:

1. An improved solenoid actuated switch assembly comprising, in combination:

a housing;

a solenoid defining an axis mounted in the housing and also having a core piece actuator projecting axially and movable in response to current in the solenoid coil in a first axial direction;

biasing means for biasing the coil piece actuator in the opposite axial direction;

a laterally pliable cam follower projecting axially from the end of the corepiece actuator;

a cam affixed to the housing and cooperative with the follower;

a contact blade actuator comprising a compressible biasing member extending from the corepiece actuator; and a movable contact blade with a movable contact mounted on the housing for movement transverse to the axis to make and break a circuit, and also connected to the contact blade actuator and cooperative with a fixed contact, said blade being movable in response to movement of the contact blade actuator to engage and disengage contacts to make and break a circuit.

2. The switch assembly of claim 1 wherein the compression biasing member comprises a compression spring pivotally attached at one end to the corepiece actuator and pivotally attached at the opposite end to the movable contact blade.

3. The switch assembly of claim 1 wherein the cam follower comprises a cantilever arm pivotally attached to the corepiece actuator and a spring member applying a component of force on the arm perpendicular to the direction of the corepiece actuator axis whenever the arm forms an angle with the axis and providing means for maintaining the follower against the active surface of the cam.

4. The switch assembly of claim 1 wherein said corepiece actuator includes a sliding block affixed to the end of the corepiece actuator, said block comprising a pivot mount for the follower and the contact blade actuator, and also comprising a stop for the biasing means.

5. The switch assembly of claim 1 wherein said housing includes three separate recesses, said recesses comprising generally parallel recesses aligned axially with the corepiece actuator axis, the center recess adapted to receive the corepiece actuator, and each of said side recesses adapted to receive contacts and contact blades; said assembly including a contact blade actuator projecting laterally into each side recess from the corepiece actuator.

6. The assembly of claim 1 wherein said housing is formed from a molded insulating block having parallel recesses defined in opposite sides of the block, said recesses connected by a passage through a wall between the recesses.

7. The assembly of claim 6 including cover plates for the opposite sides of the block to retain the components within the recesses and insulate the components.

8. The switch assembly of claim 1 wherein the contact blade moves generally transversely away from the axis to make a circuit by engaging a fixed contact, in the housing;

said compressible biasing member having a non-compressed length which is greater than the distance between the connections of the biasing members to the actuators when the contact blade is in the closed circuit position whereby the biasing member is compressed in the closed circuit position and provides a principal force component transverse to the solenoid axis.

9. The switch assembly of claim 1 wherein the movable contact blade moves generally transversely away from the axis to make a circuit, and wherein the compressible biasing member is a compressible spring connected at one end to the corepiece actuator and connected at its opposite end to the movable contact blade, said spring being in compression and extending generally transversely when the corepiece actuator and contact blade are in the closed circuit position, and said spring being out of compression when said corepiece actuator and blade are in the open circuit position, said spring thereby forming an acute angle with the axis.

10. The switch assembly of claim 1 wherein the compressible biasing member is compressed with the contact blade is in the closed position and provides a vector force compressing the contacts when the contact blade is in the closed position proportional to the amount of compression, and wherein the biasing member has no vector force on the contact blade when the contacts are open.

11. The switch assembly of claim 1 wherein the compressible biasing member provides a vector component of force in the first axial direction.

12. The switch assembly of claim 1 wherein said movable contact blade actuator is pivitally attached to a fixed conductive holder in the housing said holder including a conductive fastener, at least two flexible leads attached at opposite ends of the fastener, said blade actuator also including a fastener with the leads connected to the opposite ends of the said fastener, said leads crossing one another as they extend from one fastener to the other.

13. The switch assembly of claim 1 including a buss bar connection, mounted in the housing, said buss bar connection including a fixed conductive plate in a recess in the housing, a pivotal plate in opposed relation to the fixed plate and pivotal about an axis along an edge of the fixed plate, biasing means for maintaining the pivotal plate spaced from the fixed plate to receive a buss bar, and a drive member mounted on the housing to engage the pivotal plate and drive the plate against the biasing means into engagement with a buss bar inserted between the plates.

14. The improvement of claim 13 including a cylindrical buss bar projecting through a compatible opening in the housing to a position between the plates, said buss bar being rotatable to any desired position, and being attached at its outside end to a contact member.

15. In a bistable position switch of the type including a coil, a corepiece actuator movable with respect to the coil and responsive to current passing through the coil, a corepiece actuator holding and release mechanism for effectively maintaining the corepiece actuator in a first coil actuated position upon termination of current through the coil and in a second release position upon subsequent actuation of the corepiece actuator by the coil and release thereof, said mechanism of the type including:

(a) a cantilever member projecting from the corepiece actuator, said member being flexible in a plane generally parallel to the direction of corepiece movement;

(b) a cam guide member fixed with respect to the cantilever member, said cam guide member being cooperative with the cantilever member and including a (i) first track for guiding the cantilever member to a notch holding position, and (ii) a second track for guiding the cantilever member from the notch holding position to a release position; the improvement comprising, in combination:

a rigid cantilever member pivotally attached at one end to the corepiece actuator at a point on the axis of translation of the corepiece, and biasing means affixed to the arm to bias the arm toward a parallel position with the axis, said arm including a follower pin for cooperation with the cam guide member; and a transversely projecting compression spring means pivotally attached to the actuator at one end and attached to a movable contact blade at the opposite end to drive the blade between an open and closed position.

16. The improvement of claim 15 wherein the compression spring means provides a compressive force vector along an axis transverse to the actuator axis greater than the compressive force vector along the actuator axis in both the first and second positions.

17. The improvement of claim 16 including corepiece actuator biasing means biasing the corepiece actuator along the axis opposite the direction of corepiece movement by passing current through the coil, and wherein the coil force on the corepiece actuator always exceeds the vector sum of all biasing means.

* * * * *